United States Patent [19]

Foresto

[11] 4,434,725

[45] Mar. 6, 1984

[54] MASS BURNING SELF-CLEANING INCINERATOR

[76] Inventor: Samuel Foresto, 243 Willis Ave., Mineola, N.Y. 11501

[21] Appl. No.: 407,813

[22] Filed: Aug. 13, 1982

Related U.S. Application Data

[62] Division of Ser. No. 348,977, Feb. 16, 1982, Pat. No. 4,366,759.

[51] Int. Cl.[3] ..... F23G 5/04

[52] U.S. Cl. ..... 110/346; 110/225

[58] Field of Search ..... 110/225, 247, 236, 248, 110/251, 258, 346; 432/139; 99/448, 450

[56] References Cited

U.S. PATENT DOCUMENTS

| | | | |
|---|---|---|---|
| 2,015,050 | 9/1935 | Baird et al. | 110/225 |
| 2,015,052 | 9/1935 | Hantley | 110/225 |
| 2,222,673 | 11/1940 | Lewens | 110/225 |
| 2,419,261 | 4/1947 | Groetchen | 99/448 |
| 3,329,141 | 7/1967 | McClure | 110/258 |
| 3,369,482 | 2/1968 | Kahn et al. | 99/450 |
| 3,552,299 | 1/1971 | Patoka | 99/448 |
| 3,777,680 | 12/1973 | Eck | 110/225 |
| 3,780,674 | 12/1973 | Lin | 110/248 |
| 3,956,979 | 5/1976 | Covonoos | 99/447 |
| 4,013,023 | 3/1977 | Tombana et al. | 110/225 |
| 4,020,322 | 4/1977 | Muse | 99/450 |
| 4,046,086 | 9/1977 | von Dreusche, Jr. | 110/225 |
| 4,176,611 | 12/1979 | von Dreusche, Jr. | 110/225 |
| 4,182,246 | 1/1980 | Tombana et al. | 110/225 |
| 4,248,164 | 2/1981 | Isheim | 110/225 |
| 4,347,156 | 8/1982 | Tombana et al. | 110/225 |

*Primary Examiner*—Edward G. Favors

*Attorney, Agent, or Firm*—Bauer & Amer

[57] ABSTRACT

A method and apparatus for the consumption of relatively mass amounts of refuse in which a plurality of refuse burning grates are spaced one above the other. The refuse is supplied to and deposited selectively on selected ones or all of the grates while the grates are rotating so as to substantially evenly distribute the refuse thereon. The refuse is ignited to cause the same to burn and be consumed thereby becoming reduced in size such that the smaller sized refuse is enabled to fall through the grates producing a continual cleaning of the grates.

6 Claims, 1 Drawing Figure

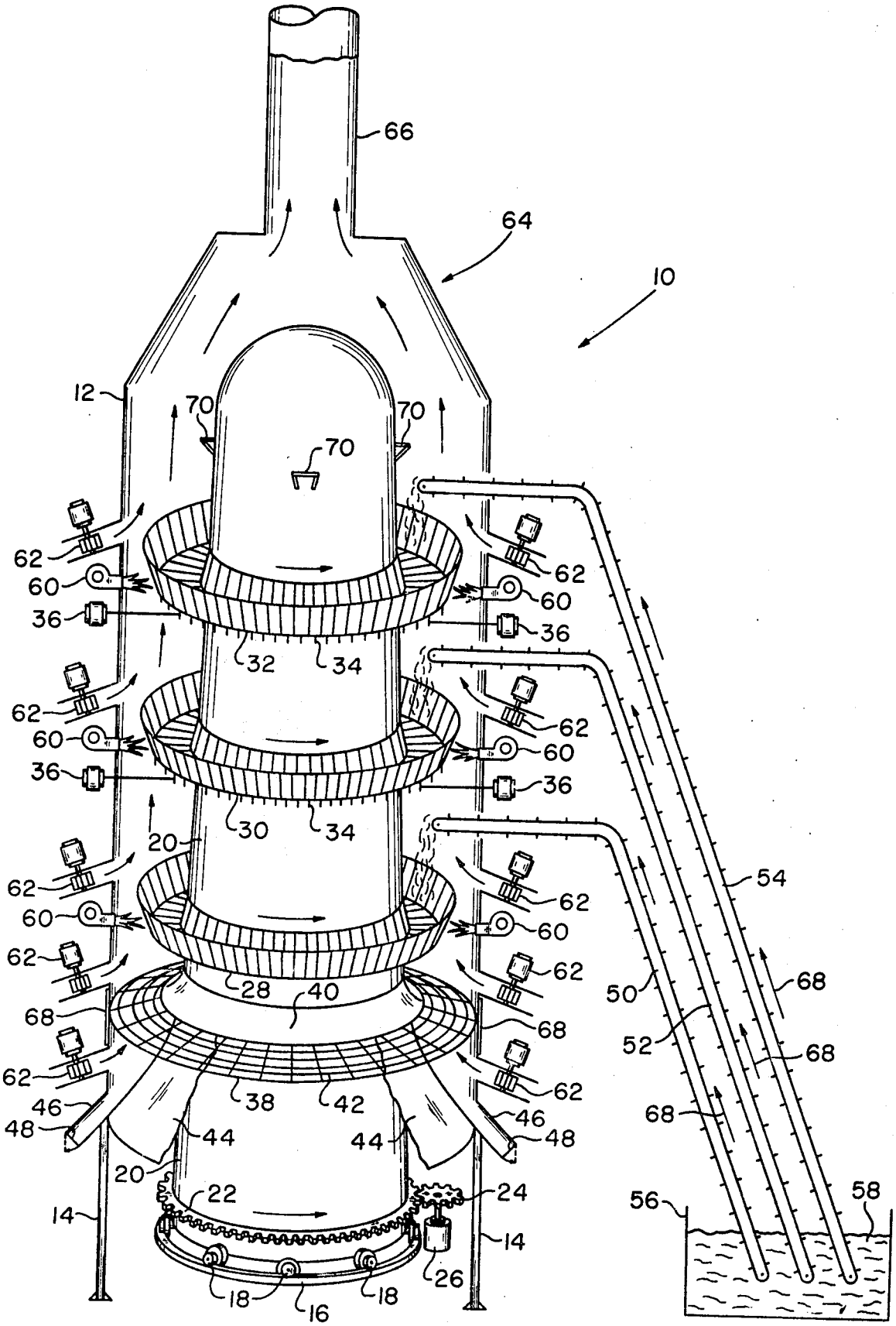
66
64
10
12
70
70
70
62
60
36
32
34
30
34
20
28
40
68
38
42
46
48
44
22
24
14
26
18
16
54
50
52
56
58

MASS BURNING SELF-CLEANING INCINERATOR

This is a division of application Ser. No. 348,977, filed Feb. 16, 1982, U.S. Pat. No. 4,366,759.

The invention relates to incinerators. More particularly, it relates to the burning and consumption of unusually or relatively large mass amounts of refuse within a given period of time in an incinerator of a relatively small volume.

Disposal of the daily production of large amounts of refuse in the form or discarded articles, garbage, waste materials and other unneeded items is fast becoming a problem facing every community throughout the world. The need to find methods and means for the sanitary disposal of such refuse without doing short and long term damage to the environment, including the air we breathe and the water we drink, is an all consuming problem facing every nation on this earth. Dumping at sea or burying such refuse on land are only interim solutions.

Incineration will solve the problems of disposal of such refuse except that incinerators known heretofore have failed in their functions of consuming the relatively mass quantities of daily generated refuse. When large capacity incinerators have been employed, they have failed to adequately consume the refuse. It has been found that large incinerators are incapable of handling the mass amounts of refuse because the refuse clogs the incinerator and the waste gases emitted by the burning of the refuse are exhausted into the atmosphere.

Because of the inability of large incinerators to adequately burn and consume the refuse, the waste gases exhausting into the atmosphere have, at times, had entrained in them noxious and sometimes disease producing pollutants. The ebb and flow of the winds of the atmosphere have carried the pollutants to surrounding communities, land masses and drinking reservoirs to pollute the same. The problem of incomplete incineration of mass amounts of refuse has persisted despite all efforts to solve the same.

The present invention teaches a clean burning self-cleaning incinerator for the continuous consumption of mass amounts of refuse within a limited volume. This is accomplished by the use of a plurality of relatively spaced grates onto which the refuse is deposited. The grates are arranged in tiers spaced one above the other. This serves to divide and separate the refuse into manageable easily consumable amounts. Each amount of separated refuse is thereby capable of being incinerated separately while the heat of the whole incinerator aids in the more complete burning and consumption of the refuse such that the resultant hot waste gases exhausted into the atmosphere are cleaned of noxious and disease containing pollutants.

The relatively spaced grates are subjected to a rotary motion while the refuse is deposited on them so that the refuse is dispersed substantially evenly. Burning is induced and accomplished during such rotation thereby subjecting the refuse to an even fire that is provided within the incinerator. The fire ignites and burns the refuse on the grates. Such fire is aided and supplemented by the fires on each of the grates so that the grates below supply their flames to the refuse on the grates thereabove to ignite and burn the refuse more fully. The burning consumes the refuse to reduce the same in size and enables the reduced sized refuse to fall to lower tiers where they are more quickly and fully consumed.

Refuse on the upper tiers is constantly subjected to the greater amounts of heat which heat is also concentrated such that the hot waste gases leaving the incinerator are scrubbed clean of particles of pollution before they are exhausted to the atmosphere. Although not disclosed in the present invention, it will become apparent to those who are skilled in the art that heat exchangers or reclaimers may be included within the chimney and the pertinent portions of the enclosure to remove some of the heat of the hot waste gases for useful work performing purposes.

Rotating incinerators have long been known. Some of these are disclosed in U.S. Pat. Nos. 2,015,050, 2,015,052, 2,222,673, 2,560,578, 4,154,643, and 4,176,611. Such prior art structures have generally involved the controlled serpentine filtering of refuse within a rotating incinerator. Because of the required restricted filtering movement of the refuse, long periods of time are required to fully consume the same, thereby making it difficult to fully burn and completely consume mass amounts of refuse within relatively short periods of time within a relatively small volume.

The above description, as well as further objects, features and advantages of the present invention, will be more fully appreciated by reference to the following detailed description of a presently preferred, but nonetheless illustrative, embodiment in accordance with the present invention when taken in conjunction with the accompanying drawing wherein:

The FIGURE of the drawing is a perspective view of a vertical section of an incinerator constructed according to the teaching of the invention.

Referring to the drawing, the incinerator structure theredisclosed is generally identified by a numeral 10 and includes an incinerator 12 that is shown conveniently supported spaced above a ground surface by support standards or struts 14. It will become clear as the description proceeds that the enclosure 12, which could either be a thick one wall or a multiple wall construction, and also arranged to function as a heat exchanger, may be mounted directly upon a ground surface; however, raising it off the ground provides for clearance at the underside or areas beneath the incinerator structure for easy access and repair of structure that will be described hereafter. There may be any number of supports 14 of sufficient height to raise the incinerator above a floor level to provide access to the underside of the same. The supports 14 may be of any desired construction and may include a solid foundation with wall openings that afford access to the normally inaccessible underside of the incinerator 10.

Located conveniently beneath the incinerator enclosure or housing 12 is a rotary operating mechanism that includes a track 16 that guidingly supports a plurality of bearing elements 18. The guided bearing elements 18 are rollable in engagement with and on the track 16 for the purpose of free rotating movement of a rotatable grate support or standard 20. The support member 20 mounts the plurality of rollable bearing elements 18 spaced relatively about the outer periphery thereof so as to permit substantially free and relatively unhindered rotation of the support 20 within the enclosure 12.

To effect the controlled speed of rotation of the support 20, it is provided with a ring gear 22 mounted at the lower portion thereof for rotative meshing engagement with a driving spur gear 24 that is conveniently operated by an electrical drive or motor 26. Although only one such spur gear 24 and drive motor 26 is illustrated, it will be apparent that additional driving motors or spur gears may be utilized for engagement with the ring gear 22 shown or with like multiple ring gears 22 to cause the controlled rotation of the grate support 20.

The particular arrangement of rotative drive and bearing support hereshown is but one illustration of other drives and supports that may be utilized depending upon the weight and mass of the refuse to be supplied to and consumed within the incinerator structure 10. Larger, smaller or other forms of drives and supports may be utilized without deviating from the concept of the invention. In like manner, the speed of rotation of the support 20 may be selectively controlled by adding a conventional gear box or speed control mechanism (not shown) between the drive motor 26 and the drive gear 24. Although such speed control is not shown, it will become apparent that the speed at which the support 20 rotates can effect an increase in the burning and consumption of the refuse in the incinerator 10.

The grate support 20 is elongated in length and may be cylindrical or generally of conical or sloping configuration as shown. This enables a plurality of refuse burning grates to be arranged on the support 20 in tiers one above the other in a manner as is illustrated in the drawing for rotation with the same. In the present illustration of the invention, only three grates 28, 30 and 32 are shown. A novel feature of the invention resides in its ability to increase or decrease the number of tiers of grates as the needs require. Each grate is positioned and mounted about the circumference of the support member 20 in vertical spaced relationship therealong with each grate being positioned one above the other such that the fire of the refuse burning on a lower grate will ignite and cause the refuse to burn on the grates above, and more especially on the grate immediately above. Each grate is substantially identical to the other, but it also may vary somewhat, as long as each contains a plurality of mesh-like structures that may be made of conventional materials capable of withstanding great heats to which the same are subjected during the burning of the refuse thereon.

The grates may be provided with openings at their bottoms and also at the sides thereof to permit refuse reduced in size by burning and the products of their consumption to fall through each of the grates. Each of the grates is provided with jogging grate cleaning shaker elements 34 that are conventionally employed for the purpose of reciprocation and shaking clean ash and residue forming on the grate to cause the same to fall through the openings thereof. Such jogging shaker structures are illustrated in the drawing as being capable of being automatically rotated within or below the grates 28, 30 and 32 by separate shaker motors 36 connected to them. For convenience of description and explanation, the shaker elements 34 and their actuating means 36 are illustrated only in connection with the upper grates 30 and 32. It is to be understood that the same may be utilized on and in connection with all of the grates.

Mounted on the support 20 beneath the lowermost grate 28 is a catch screen 38 that may be fixed to the rotatable grate support 20 for rotation therewith. Alternatively, it may be fixed in position to the housing enclosure 12 to be mounted peripherally about and in engagement with the circumference of the grate 20 as is illustrated in the FIGURE of the drawing to permit the rotation of the support 20 while it remains stationary. The catch screen 28 has an apron 40 that is curved downward from its point of mounting on the rotatable support 20 to guide refuse or other materials that fall from the grates thereabove onto the circumferentially outer mesh or screen-like surface 42. The screen 38 may be in a form of a grate and with an automatic grate shaker.

Positioned beneath the apron 40 is a curved deflector 44 that aligns with refuse disposal passages 46 that function as chutes. Refuse falling through the screen 42 and onto the lower portion of the apron 44 are directed to the chutes 46 that may have collector receptacles positioned therebeneath. The passages or chutes 46 may be normally closed by a door 48 which can be opened to permit the release of refuse therefrom into a collector receptacle (not shown) positioned therebeneath.

For convenience, only two such refuse disposal chutes or passages 46 are illustrated in the drawing. The size, number and placement of such chutes may be increased or decreased as the need for the same is demonstrated. However, the same do provide for ready and easy collection of refuse that is not fully consumed in the incinerator as will become clear as the description proceeds.

Conveyor means are provided for supplying and depositing refuse onto each of the refuse burning grates 28, 30 and 32. Substantially even distribution of the refuse for the more rapid burning and consumption of the same is enhanced when refuse is conveyed to the grates while the same are rotating. It is within the contemplation of the present invention to supply to selected ones of the grates selected types of refuse for their more rapid burning and consumption. For example, wet refuse will dry faster at the upper grates and will burn more quickly than on the lower grates.

To accomplish this more conveniently, the drawing illustrates three separate conveyors 50, 52 and 54. Each conveyor is associated with a respective one of the grates 28, 30 and 32. By so providing a multiplicity of conveyors, each to be used to supply and deposit refuse on a respective one of the grates, individual and selective control of each conveyor and the refuse to be deposited on a selected grate is enhanced.

However, for those who might wish to use less than a separate conveyor for each respective grate, it is foreseeable, and within the scope of the present invention, that the number of conveyors may be reduced. In so doing, a single conveyor may be used to supply refuse selectively to different ones of the refuse burning grates as and when the operator of the incinerator desires.

When a separate conveyor is provided for the supply and deposit of refuse on a respective one of the grates, all of the conveyors may be operated at one time and all of the grates will receive substantially even distributions of refuse thereon. This enhances the burning and the consumption of the refuse since no one grate is overloaded with refuse that may tend to slow the incineration process.

In the present invention, the conveyors 50, 52 and 54 are shown to be used in connection with a single refuse collection receptacle 56 having refuse 58 dumped or deposited therein as a result of the dumpings from garbage trucks and the like. It should be clear that refuse may be separated into different receptacles 56 according to its burning characteristics. Each conveyor may be associated with a respective receptacle 56 for the selected supply of such refuse to its respective grate.

At each tier of refuse supporting or burning grates 28, 30 and 32, there is provided about the periphery thereof refuse igniting means in the form of fire burners 60. The burners 60 may be of the oil burner or gas burner types. The burners 60 are positioned about each of the respective tiers so as to ignite and cause the refuse in the tiers to burn and to be consumed. To aid in the ignition of the refuse by the burners 60 and in their continued burning and consumption of the refuse, there is provided a plurality of an unspecified number of air or oxygen supply means in the form of blowers 62.

The blowers 62 may be conveniently positioned and relatively spaced about the interior of the enclosure 12 to draw air from the surrounding atmosphere into the same and are directed at or toward each of the tiers of refuse burning grates. They supply sufficient air and oxygen from the surrounding atmosphere to the interior of the enclosure 12 to enhance the ignition and burning of the refuse on the grates by the burners 60. They also encourage the rapid continued burning and final consumption of the refuse. The blowers 62 may be of any conventional design in the same manner as are the burners 60.

The enclosure 12 houses the rotatable support 20 and its refuse burning grates in substantially close conformation. That is to say, the housing enclosure conforms closely in shape to that of the interior structure contained therewithin. The enclosure is intended to contain, to direct and to concentrate the fires and their produced heats so as to effect a more efficient controlled burning of the refuse. The drawing shows the walls of the enclosure 12 sloping substantially coincident with that of the support 20 and closely spaced relative to the grates.

The top of the enclosure is narrowed sharply and severely at 64 at its connection with the chimney 66. The chimney 66 may vent the hot waste gases directly into the atmosphere. However, in practice it is intended that the incinerator 10 be employed for more useful purposes by permitting the hot waste gases to be conducted by the chimney 66 to other work performing structures and apparatuses where the heat of such gases may be used for driving turbines, heating buildings and the like.

Therefore, although the drawing does not show the chimney 66 connected with any such apparatuses or structures, it is within the contemplation of the present invention that the incinerator 10 may be used with different types of apparatuses such as are disclosed, for example, in my co-pending applications Ser. Nos. 221,974 filed Jan. 2, 1981, and 302,487 filed Sept. 16, 1981. The incinerator 10 may be connected as an integral working part of my aforementioned inventive apparatuses by joining the same thereto at the chimney 66. When so joined, the chimney 66 will vent the hot waste gases from the incinerator 10 of the present invention directly into the appurtenant apparatus to which it is connected rather than directly into the atmosphere. It may have a double-walled structure, also as taught in my prior disclosure, to enable the exchange and extraction of heat from the enclosure wall 12 thereby to cool the same while permitting the performance of useful work with the extracted heat.

At the start of the operation the refuse dumped or deposited in a single receptacle 56, or in separate like receptacles for selectively segregated refuse, is selectively removed therefrom by one or more of the conveyors 50, 52, and 54 each of which is selectively operable in the direction of the arrows 68. Prior to the start of the conveyors it is suggested that the support 20 be in the rotating mode so that refuse being supplied to and deposited on the grates is distributed substantially evenly thereon. It is also suggested that the refuse igniting fires or burners 60 and the air suppliers 62 be operating so that the interior of the enclosure 12 is brought to operating heating temperature.

When the enclosure 12 is at operating temperature, the grates 28, 30 and 32 will be sufficiently hot to cause an almost immediate or instantaneous ignition and burning of refuse deposited thereon. As a consequence, when the refuse actually is supplied to and deposited on the grates by the respective conveyors, they ignite and begin to burn almost immediately. Since the grates are rotating while the refuse is being deposited thereon, the refuse is continually being subjected to the igniting flames of the burners 60 and the air of the blower 62 thereby inducing a relatively even burning of the refuse completely about the grates. This permits each tier of grates to function effectively as an independent and separate incinerator of the refuse thereon.

In addition to the independent incinerator operation of each tier of grates, each tier also enhances, encourages and actually ignites the firing and burning of the refuse on the tiers of the grates above, and more particularly the refuse on the grate immediately thereabove. To this end it has already been noted that there may be any desired number of independent tiers of grates mounted on and for rotation with the support 20. In practice, such tiers of grates will be spaced one above the other a distance that will enable the fire of the refuse on a grate below to reach, ignite and burn the refuse on the grate thereabove.

The benefit of this arrangement is to supplement the functions of the igniting fires of burners 60. The importance of this arrangement should be readily apparent. Oftentimes incinerators are prevented from or hampered in their proper intended manner of operation by particularly humid or wet refuse and/or weather conditions that inhibit the rapid burning of the refuse. These problems may be further compounded by an unusually large accumulation of refuse that is difficult to ignite and to maintain the burning of the same to complete its consumption.

By providing the igniting fires 60 and air supplies 62 initial ignition and burning is encouraged and achieved. Stubborn refuse, resistant to such initial burning effects, will be dried and further conditioned for burning by the heat of the refuse burning on the tiers below. By selectively depositing more rapidly consumable refuse on the lower tiers, the heat generated by their fires rises to the more stubborn refuse above to fire and continue their drying and burning. The fire of such refuse above, in turn, adds heat to the enclosure 12 that becomes a total, almost closed inferno of immense heat and flame. By configuring and shaping the enclosure 12 to a constricted narrowed upper portion at the sloping narrowed wall 64, tremendous heats are concentrated thereat before the hot waste gases are permitted to exhaust from the enclosure by way of the chimney 66.

Such tremendous or high heats surround the upper tiers of the grates. When wet, humid or otherwise stubbornly consumable refuse must be disposed of, they are deposited onto these tiers. The immense heat quickly dries and conditions such stubborn refuse for ignition and burning. As the refuse is burned and consumed, it decreases or reduces in size. The openings provided in the grates permit such refuse to drop through and filter down to a grate below so the grate is continually being cleaned. When the burning refuse filters downward and reaches the grate below, it adds its fire to the new refuse deposited on the top of the grate on which the same falls. This creates an additional fire and burning on the top of the newly deposited refuse to increase the speed of the burning cycle.

As a consequence, each tier functions not only as a separate incinerator, but also functions as a source of drying, heating, ignition and burning of refuse on the tiers above and below. By the time the refuse is consumed and reduced in size that it finally falls and filters down to the lower tier, it is sufficiently small and dry to be easily fully consumed thereat. If it is not fully consumed at the lower tier, it will fall through the openings of the grate onto the collector apron 40 where it will be directed to the grate or screen 42. If the refuse is still too large to fall through the screen 42, it will be collected on the screen and subsequently will be manually removed or automatically removed therefrom through access doors or panels 68 conveniently located in the enclosure 12.

If the refuse is small enough to fall through the grate or screen 42, it will fall onto the deflector 44 therebelow. The deflector 44 will direct such small unconsumed ash-like particles to the chutes 46 for collection therein and disposal therefrom at a later time into receptacles (not shown) positioned below. Collection in the chutes 46 is contained by closed doors 48 that may subsequently be opened when the receptacles are positioned beneath the chutes. All of this collection of unconsumed refuse is enhanced by the continuous rotation of the support 20 and the aforementioned structures connected to it.

The hot waste gases that are produced by the tiers of incineration tend to rise rapidly upward through the grates above permeating through their refuse. The great heat of the waste gases helps to increase the burning and speed of consumption in the towering inferno of the enclosure 12. It has the additional benefit of self-cleaning the waste gases. By necking or narrowing the enclosure at 64, the hot gases are forced to strike against the enclosure and release much of their heat to the walls of the same, including the wall 64. This concentration of heat at the top of the enclosure now enables the enclosure to function as a scrubber and cleaner of the waste gases.

As the hot waste gases rise from the tiers of the burning refuse, they carry or have entrained in them unconsumed particles of pollution. When the gases strike and bounce against the narrowed enclosure and release their heat thereto, the particles of pollution entrained in them also strike against the very hot surfaces. The high heat of such surfaces immediately sparks and burns the particles to fully consume them. This produces a scrubbing and cleaning effect upon the waste gases before the gases have the opportunity to exhaust from the enclosure 12 at chimney 66 to the atmosphere or to attendant structures.

If the chimney 66 is joined to an appurtenant apparatus, for example, one of the apparatuses disclosed in my aforementioned inventions, the hot waste gases will be further scrubbed and cleaned before they are released into the atmosphere. In such apparatuses the waste gases also will be so directed as to enable extraction of the heat therefrom for performing useful work.

Access to the interior of the enclosure is afforded by the access door 68 and other like means that may be provided about the enclosure. Step-like members 70 may be provided about the support 20 to facilitate scaling the same to enable repair thereof. Although from time to time repair of the operating structures may be required, the incinerator 10 operates substantially clean burning and self-cleaning. The self-cleaning is achieved when the refuse is reduced in mass and size and falls free of the grates to leave them clean. What refuse remains unconsumed is collected below through the access openings 68 or at the chutes 46. Whatever minor residue of ash remaining on the grates is then cleaned off by the shakers 34.

While there have been shown and described and pointed out the fundamental novel features of the invention as applied to a preferred embodiment thereof, it will be understood that various omissions and substitutions and changes in the form and details of the device illustrated and in its operation may be made by those skilled in the art without departing from the spirit of the invention. It is the intention, therefore, to be limited only as indicated by the scope of the claims appended hereto.

What is claimed is:

1. The method of burning mass amounts of refuse in an incinerator comprising conveying refuse to a plurality of rotating refuse burning grates arranged spaced one above the other while applying a fire to the refuse on the grates to burn and consume the same, rotating the tiers on which refuse is deposited to subject the refuse thereon continuously to the fire created at the tiers to burn the same subsequently evenly, spacing the tiers relative to each other such that the flames of the refuse on a lower tier cause ignition of refuse on the next higher tier, providing openings in the grates to enable the heat and fire from refuse burning on grates below to ignite and burn refuse on grates above and permitting the burned refuse that is consumed and reduced in size to fall to lower grates for burning and consumption thereat, and providing for exhaust of the waste gases of combustion of the refuse from the incinerator to the atmosphere by a chimney.

2. The method of claim 1, and concentrating the heat of the waste gases in the incinerator prior to their exhaust therefrom by the chimney to further burn and consume particles of pollution contained in such waste gases before they exhaust into the atmosphere.

3. The method of burning and consuming mass quantities of refuse in an incinerator comprising separately depositing refuse on a plurality of rotating tiers arranged one above the other, creating a fire at each tier on which refuse is deposited so as to cause the refuse thereon to burn and to be consumed at each such tier, enabling the heat of the fire at lower tiers to rise and to add to the heat of the fire of tiers above to ignite and consume refuse on tiers thereabove to aid in the fuller consumption of such refuse, spacing the grates with respect to each other such that the flames of a lower grate cause ignition of the refuse on a higher grate, and when the refuse is reduced in size by the burning and consumption of the same, permitting the refuse to fall from the tier on which it was deposited to lower tiers to enable the tiers from which the refuse falls to be cleaned thereof.

4. The method as in claim 3, depositing selected types of refuse on selected ones of said tiers.

5. The method as in claim 4, concentrating the heat at the higher tiers to induce the consumption of the refuse more rapidly thereat.

6. The method as in claim 3, exhausting to the atmosphere the waste gases resulting from the consumed refuse and collecting the unconsumed refuse below the tiers.

* * * * *

UNITED STATES PATENT AND TRADEMARK OFFICE

CERTIFICATE OF CORRECTION

PATENT NO. : 4,434,725

DATED : March 6, 1984

INVENTOR(S) : Samuel Foresto

It is certified that error appears in the above-identified patent and that said Letters Patent are hereby corrected as shown below:

IN THE CLAIMS:

Claim 1, lines 6-11, delete "rotating the tiers on which refuse is deposited to subject the refuse thereon continuously to the fire created at the tiers to burn the same subsequently evenly, spacing the tiers relative to each other such that the flames of the refuse on a lower tier cause ignition of refuse on the next higher tier" and substitute the following: --spacing the grates with respect to each other such that the flames of a lower grate cause ignition of refuse on a higher grate--

Claim 3, lines 12-14, delete "spacing the grates with respect to each other such that the flames of a lower grate cause ignition of the refuse on a higher grate" and substitute the following: --rotating the tiers on which refuse is deposited to subject the refuse thereon continuously to the fire created at the tiers to burn the same substantially evenly,

UNITED STATES PATENT AND TRADEMARK OFFICE

CERTIFICATE OF CORRECTION

PATENT NO. : 4,434,725 Page 2 of 2

DATED : March 6, 1984

INVENTOR(S) : Samuel Forest

It is certified that error appears in the above-identified patent and that said Letters Patent is hereby corrected as shown below:

spacing the tiers relative to each other such that the flames of the refuse on a lower tier cause ignition of refuse on the next higher tier--

Signed and Sealed this

*Twenty-ninth* Day of *May 1984*

[SEAL]

*Attest:*

GERALD J. MOSSINGHOFF

*Attesting Officer* *Commissioner of Patents and Trademarks*